US009888752B2

(12) United States Patent
Den Boer et al.

(10) Patent No.: US 9,888,752 B2
(45) Date of Patent: Feb. 13, 2018

(54) LUGGAGE ITEM, A LUGGAGE ITEM SYSTEM, A LUGGAGE ITEM ADAPTOR

(71) Applicant: ROYALTY BUGABOO GMBH, Zug (CH)

(72) Inventors: Jacob Geert Arie Den Boer, Amersfoort (NL); Vincent Bernardus Hubertus Ten Horn, Haarlem (NL); David McMillan, Leiden (NL); Machiel Gerardus Theodorus Marie Barenbrug, Amsterdam (NL)

(73) Assignee: ROYALTY BUGABOO GMBH, Zug (CH)

( * ) Notice: Subject to any disclaimer, the term of this patent is extended or adjusted under 35 U.S.C. 154(b) by 57 days.

(21) Appl. No.: 14/413,819

(22) PCT Filed: Jul. 5, 2013

(86) PCT No.: PCT/EP2013/064218
§ 371 (c)(1),
(2) Date: Jan. 9, 2015

(87) PCT Pub. No.: WO2014/009261
PCT Pub. Date: Jan. 16, 2014

(65) Prior Publication Data

US 2015/0136553 A1 May 21, 2015

(30) Foreign Application Priority Data

Jul. 9, 2012 (EP) ..... 12175589

(51) Int. Cl.
*A45C 5/14* (2006.01)
*A45C 7/00* (2006.01)
(Continued)

(52) U.S. Cl.
CPC ..... *A45C 5/14* (2013.01); *A45C 5/03* (2013.01); *A45C 7/0045* (2013.01); *A45C 7/0086* (2013.01); *A45C 13/385* (2013.01)

(58) Field of Classification Search
CPC ..... A45C 5/14; A45C 5/03; A45C 7/0045; A45C 7/0086; A45C 13/385
See application file for complete search history.

(56) References Cited

U.S. PATENT DOCUMENTS 1,409,838 A 3/1922 Emery et al.
2,454,438 A * 11/1948 Falk ..... B65D 85/305 206/144
(Continued)

FOREIGN PATENT DOCUMENTS

AU 2016767 A 10/1969
CA 1151116 A 8/1983
(Continued)

OTHER PUBLICATIONS

International Search Report and Written Opinion for PCT Patent App. No. PCT/EP2013/064218 dated (Oct. 4, 2013).

*Primary Examiner* — Tri Mai
(74) *Attorney, Agent, or Firm* — Kenealy Vaidya LLP

(57) ABSTRACT

A luggage item, a luggage item system and a luggage item adaptor are provided. The luggage item is for use in luggage system comprising a luggage trolley and another luggage item. The luggage item comprises a first side, a second side, a first coupling element and a second coupling element. The second side is opposite the first side and is separated by flanks from the first side. The first side and the second side have an area larger than the areas of the flanks. The first coupling element is arranged at the first side. The second coupling element is arranged at the second side for engaging with a first coupling element of the other luggage item to releasably attach the other luggage item to the luggage item
(Continued)

and for engaging with a trolley coupling element of the luggage trolley to releasably attach the luggage item to the luggage trolley.

3 Claims, 8 Drawing Sheets

(51) Int. Cl.
*A45C 13/38* (2006.01)
*A45C 5/03* (2006.01)

(56) References Cited

U.S. PATENT DOCUMENTS 2,602,675 A 7/1952 Forman
3,131,829 A * 5/1964 Masser ..... B65D 21/0204 206/144
3,178,197 A 4/1965 Boatner
3,317,081 A * 5/1967 Cornelius ..... B65D 21/0204 206/144
3,659,867 A 5/1972 Curry
3,842,953 A 10/1974 Royet
3,891,230 A * 6/1975 Mayer ..... B62B 1/14 190/18 A
3,974,898 A * 8/1976 Tullis ..... A45C 7/0045 190/108
4,087,102 A 5/1978 Sprague
4,314,624 A 2/1982 Royet
4,335,895 A 6/1982 Walker
4,575,109 A 3/1986 Cowdery
4,588,055 A 5/1986 Chen
4,673,070 A * 6/1987 Ambal ..... A45C 3/00 150/111
4,917,392 A 4/1990 Ambasz
4,953,257 A 9/1990 Seynhaeve
4,969,660 A 11/1990 Spak
5,072,958 A 12/1991 Young
5,105,962 A * 4/1992 Gotz ..... B65D 1/243 206/203
5,127,662 A 7/1992 Spak
5,263,727 A 11/1993 Libit et al.
5,310,071 A * 5/1994 Rivlin ..... B65D 81/361 206/509
5,348,325 A 9/1994 Abrams
5,533,231 A 7/1996 Bai
5,628,443 A * 5/1997 Deutsch ..... A45C 7/0086 150/113
5,630,601 A 5/1997 vom Braucke et al.
5,749,503 A 5/1998 Wulf
5,803,471 A 9/1998 DeMars et al.
5,815,843 A * 10/1998 Brillhart, III ..... A41D 13/0012 150/111
5,873,145 A 2/1999 Chou
5,984,154 A 11/1999 Scicluna
5,984,327 A 11/1999 Hsieh et al.
6,016,893 A 1/2000 Chen
6,042,127 A 3/2000 Rupolo
6,047,442 A 4/2000 Workman
6,141,841 A 11/2000 Workman
6,179,176 B1 1/2001 Saggese
6,182,981 B1 2/2001 Kuo
6,186,295 B1 2/2001 Lin
6,196,366 B1 3/2001 Lin
6,196,560 B1 3/2001 Ohisson
6,213,266 B1 4/2001 Hollingsworth
6,213,267 B1 4/2001 Miller
6,237,734 B1 5/2001 Chen
6,260,871 B1 7/2001 Liu
6,279,705 B1 8/2001 Wu
6,289,554 B1 9/2001 Wang
6,305,587 B1 10/2001 Miller
6,360,400 B1 3/2002 Chang
6,367,602 B1 4/2002 Chang
6,401,888 B1 6/2002 Kuo
6,401,890 B1 6/2002 Tan
6,409,412 B1 6/2002 Huang
6,454,065 B1 9/2002 Chen
6,471,019 B1 10/2002 Miller
6,474,524 B1 11/2002 Ivarson
6,484,362 B1 11/2002 Kuo
6,530,507 B2 3/2003 Oh
6,533,086 B1 3/2003 Waddell
6,575,493 B1 6/2003 Lowenstein
6,591,950 B1 7/2003 Scicluna
6,604,617 B2 8/2003 Davis
6,609,271 B2 8/2003 Kuo
6,736,073 B2 5/2004 Ryburg
6,769,701 B1 8/2004 Clausen
6,832,670 B2 12/2004 Wolters
6,880,685 B2 4/2005 Fenton
6,923,352 B2 6/2005 Oh
6,961,976 B2 11/2005 Kuo
6,964,420 B1 11/2005 Ghanizadeh
7,066,311 B2 6/2006 O'Shea
7,070,190 B2 7/2006 Sadow
7,073,694 B2 7/2006 King
7,093,700 B2 8/2006 Krulik
7,097,181 B2 8/2006 Sadow
7,097,183 B1 8/2006 Su
7,143,912 B2 12/2006 Caneba
7,226,073 B1 6/2007 Zahiri
7,232,018 B1 6/2007 Salander
7,237,660 B2 7/2007 Wu
7,281,616 B2 10/2007 Peterson
7,284,304 B2 10/2007 Fenton
7,318,507 B2 1/2008 Fenton
7,328,779 B2 2/2008 King
7,350,648 B2 4/2008 Gerstner et al.
7,374,183 B1 5/2008 Yen-Lung
7,426,985 B2 9/2008 Krulik
7,441,785 B1 10/2008 Tsai
7,478,803 B2 1/2009 Lee
7,594,569 B2 9/2009 Bass
7,597,341 B2 10/2009 Russo
7,780,026 B1 8/2010 Zuckerman
8,607,947 B2 * 12/2013 Morszeck ..... A45C 13/02 190/109
2001/0040080 A1 11/2001 Kuo
2002/0074332 A1 * 6/2002 Sagol ..... A01K 97/06 220/23.4
2002/0130005 A1 9/2002 Schwartz
2002/0185350 A1 12/2002 Chang
2003/0034215 A1 2/2003 Lin
2003/0034636 A1 2/2003 Ng
2004/0000457 A1 1/2004 Sanford-Schwentke
2004/0004332 A1 1/2004 Tsai
2004/0026199 A1 2/2004 Chen
2004/0074725 A1 4/2004 Shih
2004/0163910 A1 8/2004 Lee
2004/0211634 A1 10/2004 Chan
2004/0238303 A1 12/2004 Hafif
2005/0077133 A1 4/2005 Cassegrain
2005/0077706 A1 4/2005 O'Shea
2005/0098402 A1 5/2005 Cohen
2005/0103590 A1 5/2005 Hu
2005/0150733 A1 7/2005 Chen
2005/0258621 A1 11/2005 Johnson et al.
2005/0285359 A1 12/2005 Wang
2006/0010644 A1 1/2006 Foster
2006/0086583 A1 4/2006 Hoberman
2006/0102677 A1 5/2006 Nassanian
2006/0163305 A1 * 7/2006 Tong ..... A45F 3/08 224/628
2006/0175170 A1 8/2006 Brown
2006/0196743 A1 9/2006 Lin
2006/0207848 A1 9/2006 Sher
2008/0236972 A1 1/2008 Lee
2008/0060953 A1 * 3/2008 Ghassan ..... A45C 13/26 206/216
2008/0136133 A1 6/2008 Takahashi
2008/0223679 A1 9/2008 Wong
2008/0308369 A1 * 12/2008 Louis ..... A45C 5/14 190/108

(56) References Cited

U.S. PATENT DOCUMENTS

| | | | | |
|---|---|---|---|---|
| 2008/0308370 | A1 | 12/2008 | Chung | |
| 2009/0057082 | A1 | 3/2009 | Mize | |
| 2009/0139813 | A1 | 6/2009 | Francis | |
| 2009/0160147 | A1 | 6/2009 | Arthur | |
| 2009/0218187 | A1 | 9/2009 | Chung | |
| 2010/0000805 | A1 | 1/2010 | Pan | |
| 2010/0025174 | A1 | 2/2010 | Dayton | |
| 2010/0095480 | A1 | 4/2010 | Scicluna | |
| 2010/0108452 | A1 | 5/2010 | Williams | |
| 2010/0147642 | A1* | 6/2010 | Andochick | A45C 5/14 190/18 A |
| 2010/0263977 | A1 | 10/2010 | Wu | |
| 2010/0307879 | A1 | 12/2010 | Saetia | |
| 2010/0308563 | A1 | 12/2010 | Martin | |
| 2011/0247910 | A1 | 10/2011 | Darvish | |
| 2012/0160617 | A1 | 6/2012 | Qi et al. | |
| 2012/0261223 | A1 | 10/2012 | Pattni | |
| 2015/0091264 | A1 | 4/2015 | Herbault et al. | |
| 2016/0045000 | A1 | 2/2016 | Green | |

FOREIGN PATENT DOCUMENTS

| | | | |
|---|---|---|---|
| CA | 2422913 | A1 | 9/2004 |
| CA | 2547225 | A1 | 11/2006 |
| CA | 2663373 | A1 | 10/2009 |
| CA | 2948454 | A1 | 11/2015 |
| CH | 468803 | A | 2/1969 |
| CN | 2074115 | U | 4/1991 |
| CN | 102525064 | A | 7/2012 |
| CN | 202489375 | U | 10/2012 |
| DE | 1982824 | U | 4/1968 |
| DE | 3637424 | A1 | 5/1988 |
| DE | 9002279 | U1 | 5/1990 |
| DE | 10034159 | A1 | 1/2002 |
| DE | 10210448 | A1 | 9/2003 |
| DE | 202008014890 | U1 | 3/2009 |
| EP | 0159271 | A2 | 10/1985 |
| EP | 0348014 | B1 | 4/1993 |
| EP | 0853552 | B1 | 3/2000 |
| EP | 0686008 | B1 | 4/2001 |
| EP | 0697827 | B1 | 5/2002 |
| EP | 0900031 | B1 | 5/2003 |
| EP | 1475008 | B1 | 3/2006 |
| EP | 1301101 | B1 | 4/2006 |
| EP | 1925464 | A1 | 5/2008 |
| EP | 1327396 | B1 | 3/2009 |
| EP | 1479310 | B1 | 7/2009 |
| EP | 1718183 | B1 | 9/2011 |
| FR | 2681827 | A1 | 4/1993 |
| FR | 2742315 | A1 | 6/1997 |
| FR | 2752148 | A1 | 2/1998 |
| FR | 2773681 | B1 | 7/1999 |
| FR | 2804198 | A1 | 7/2001 |
| FR | 2806890 | A1 | 10/2001 |
| FR | 2819156 | A1 | 7/2002 |
| FR | 2820008 | B1 | 8/2002 |
| FR | 2821726 | A1 | 9/2002 |
| FR | 2896221 | B3 | 7/2007 |
| FR | 2904921 | A1 | 2/2008 |
| FR | 2913655 | B3 | 5/2009 |
| FR | 2922733 | A1 | 5/2009 |
| FR | 2958511 | A1 | 10/2011 |
| GB | 1099200 | A | 1/1968 |
| GB | 1406272 | A | 9/1975 |
| GB | 1479136 | A | 7/1977 |
| GB | 1593494 | A | 7/1981 |
| GB | 2168035 | A | 6/1986 |
| GB | 2245250 | A | 1/1992 |
| GB | 2297967 | A | 8/1996 |
| GB | 2298360 | A | 9/1996 |
| GB | 2301089 | A | 11/1997 |
| GB | 2314319 | A | 12/1997 |
| GB | 2330573 | A | 4/1999 |
| GB | 2377429 | A | 1/2003 |
| GB | 2403211 | A | 12/2004 |
| GB | 2425284 | A | 10/2006 |
| GB | 2429636 | A | 3/2007 |
| GB | 2436486 | B | 1/2008 |
| GB | 2440310 | A | 1/2008 |
| JP | S4849010 | U | 6/1973 |
| JP | S5328008 | U | 3/1978 |
| JP | S53108507 | U | 8/1978 |
| JP | S62198170 | U | 12/1987 |
| JP | H4131317 | U | 12/1992 |
| JP | 2005297952 | A | 10/2005 |
| KR | 20010028666 | A | 4/2001 |
| KR | 100395144 | B1 | 8/2003 |
| KR | 20140011988 | A | 1/2014 |
| NL | 1011099 | C1 | 7/2000 |
| TW | M406968 | U1 | 7/2011 |
| WO | 9522266 | A1 | 8/1995 |
| WO | 0021817 | A1 | 4/2000 |
| WO | 0203829 | A1 | 1/2002 |
| WO | 0228218 | A1 | 4/2002 |
| WO | 0245540 | A1 | 6/2002 |
| WO | 03041529 | A1 | 5/2003 |
| WO | 03063637 | A2 | 8/2003 |
| WO | 03075703 | A1 | 9/2003 |
| WO | 2004030488 | A2 | 4/2004 |
| WO | 2004080230 | A1 | 9/2004 |
| WO | 2004088163 | A2 | 10/2004 |
| WO | 2005041710 | A1 | 5/2005 |
| WO | 2005084481 | A1 | 9/2005 |
| WO | 2007019379 | A2 | 2/2007 |
| WO | 2007041770 | A1 | 4/2007 |
| WO | 2007063302 | A1 | 6/2007 |
| WO | 2007074973 | A1 | 7/2007 |
| WO | 2007079412 | A2 | 7/2007 |
| WO | 2007118705 | A1 | 10/2007 |
| WO | 2007149579 | A2 | 12/2007 |
| WO | 2008046599 | A1 | 4/2008 |
| WO | 2008071873 | A1 | 6/2008 |
| WO | 2008098116 | A1 | 8/2008 |
| WO | 2008100117 | A1 | 8/2008 |
| WO | 2008129577 | A1 | 10/2008 |
| WO | 2009005031 | A1 | 1/2009 |
| WO | 2009006888 | A2 | 1/2009 |
| WO | 2009010049 | A2 | 1/2009 |
| WO | 2009021146 | A1 | 2/2009 |
| WO | 2009029244 | A1 | 3/2009 |
| WO | 2009085334 | A1 | 7/2009 |
| WO | 2010005308 | A2 | 1/2010 |
| WO | 2010077481 | A2 | 7/2010 |
| WO | 2011139700 | A2 | 10/2011 |
| WO | WO2014/042490 | A1 | 3/2014 |
| WO | WO2015/174699 | A1 | 11/2015 |

* cited by examiner

LUGGAGE ITEM, A LUGGAGE ITEM SYSTEM, A LUGGAGE ITEM ADAPTOR

This application is a national phase filing under 35 C.F.R. § 371 of and claims priority to PCT Patent Application No. PCT/EP2013/064218, filed on Jul. 5, 2013, which claims the priority benefit under 35 U.S.C. § 119 of European Patent Application No. 12175589.6, filed on Jul. 9, 2012, which are hereby incorporated in their entireties by reference.

FIELD

Some embodiments relate to luggage items, luggage item adaptors and a luggage item system. A luggage item may be a suitcase, an item for storing good having a flat-box shape comparable to the shape of a suitcase, or a box-like item with an open end for carrying shopping goods.

BACKGROUND

Travelers often prefer the use of wheeled suitcases which have integrated wheels and a handlebar for pulling the wheeled suitcase. The advantage is that instead of carrying the whole suitcase, the traveler can pull the suitcase behind him while walking, for example, to the departure hall of an airport.

Published patent application WO02/03829A1 discloses a system for transporting items of luggage. The system includes a wheeled trolley to which a suitcase can be coupled. The trolley includes fastening means for fastening a suitcase to the trolley. The suitcase includes also fastening means for engaging with the fastening means of the trolley. The fastening means of the trolley includes, for example, slits and straps. The fastening means of the suitcase includes, for example, a hook which can be received by the slit of the trolley, and includes an opening in a back panel of the suitcase through which the strap can be guided to fasten the strap in the interior of the suitcase. The fastening means are arranged at the trolley and at the suitcase such that the suitcase can be coupled to the trolley in a position in which one of the smallest panels of the suitcase is oriented downwards. In an embodiment of the published patent applications, two relatively small suitcases may be coupled to the trolley. The trolley has two coupling means arranged above each other and each relatively small suitcase has fastening means. When the two relatively small suitcases are coupled to the trolley, they are individually coupled to the trolley and they are arranged above each other. The suitcases of the system can also be used separately in cases that the wheeled trolley is not needed—this provides flexibility in the use of the suitcase.

A drawback of the luggage transporting system of the cited patent application is that only a single large suitcase or two relatively small suitcases can be transported. Thus, the luggage transporting capacity is too small. A further drawback of the luggage transporting system of the cited patent application is that it is relatively difficult to disengage the suitcase from the trolley.

SUMMARY

Some embodiments provide a suitcase for a modular luggage system including a luggage trolley and to provide a modular luggage system which has a higher transporting capacity.

A first aspect provides a luggage item. A second aspect provides a luggage item system. A third aspect provides a luggage item adaptor. Advantageous embodiments are defined in the dependent claims.

In accordance with the first aspect, a luggage item for use in luggage system including a luggage trolley and another luggage item is provided. The luggage item includes a first side, a second side, a first coupling element and a second coupling element. The second side is opposite the first side and is separated by flanks from the first side. The first side and the second side have an area larger than the areas of the flanks. The first coupling element is arranged at the first side. The second coupling element is arranged at the second side to engage with another coupling element of the other luggage item to releasably attach the other luggage item to the luggage item and to engage with a trolley coupling element of the luggage trolley to releasably attach the luggage item to the luggage trolley. The other coupling element of the other luggage item is similar to the first coupling element.

Thus, the first side and the second side of the luggage items are the two largest surfaces of the luggage item and the flanks are the surfaces which are in between these two largest surfaces. This especially applies to flat-box shaped luggage items, however, in specific embodiments, the flanks, the first side and the second side are not completely flat surfaces but may have a slight curvature. Furthermore, the flanks are not necessary perpendicularly oriented with respect to the first side and the second side—for example, some or all the flanks may form specific angles different from 90 degrees (e.g. within the range from 60 to 110 degrees) with the first side and the second side such that the luggage item has, for example, a rectangular frustum shape (e.g. truncated pyramid), or the shape of a trapezoidal prism. If the luggage item is a suitcase, in a specific embodiment, the first side or the second side is the side which hinges open in order to obtain access to the interior of the suitcase. Examples of luggage items are suitcase, tool boxes, relatively flexible flat-box shaped items with an opening for receiving shopping goods, etc. It is to be noted that the first side and the second side of the luggage item are often indicated by, respectively, the front side and the rear side. However, in the present context, front and rear do not have a particular influence on the characteristics of the luggage item, and the first side and second side may also be, respectively, the rear side or the front side. Each one of the first side and the second side has an area that is larger than the area of the flanks. It is to be noted that this means that each one of the first side and the second side has an area that is larger than the area of each one of the flank, but does not necessary means that each one first side and the second side has an area that is larger than total sum of the areas of the flanks.

The luggage item according to an optional embodiment includes the two coupling element for flexibly coupling the luggage items to other luggage items and/or to a luggage trolley. As such, the luggage item has a very flexible use. For example, the luggage item is a relatively small cabin suitcase, which is coupled during transportation to a suitcase with the two coupling elements, and at checking in the relatively small cabin suitcase is disengaged from the suitcase such that the suitcase can be checked in. Or, the luggage item is a suitcase coupled to a luggage trolley. At checking in for a flight, the suitcase is uncoupled from the luggage trolley and checked in, and the luggage trolley is moved into its compact mode such that it is compact enough to be placed in the overhead bins of an airplane cabin. Furthermore, the uncoupling allows the owner of the luggage trolley and luggage item to decide which parts of the luggage system are checked in for the baggage compartment, and which parts are taken with him into the cabin. Especially today airplane companies tend to charge for too large cabin luggage, or too heavy checked in baggage, and by using the flexible luggage item of the invention, the user may select to check in specific pieces of the luggage system such that the costs are limited.

The different luggage items which can be coupled to each other do not need to have the same size, which even increases the flexibility of the luggage system which includes the luggage items. The main characteristic is that the luggage item has the first coupling element and the second coupling element and that the other luggage item has the other coupling element. Optionally, all the coupling elements are arranged at the luggage items at the same distance from the ground when the luggage items are placed in an upright position.

Thus, the luggage item of this optional embodiment enables the use of multiple luggage items on one luggage trolley without being limited to the size of the multiple luggage items. Thus, a more transporting capacity is obtained.

Furthermore, the luggage item may be easily engaged with the trolley or the other luggage item with a relatively simple coupling element and disengaging is, therefore, relatively easy.

Characteristics of the first coupling element and the second coupling element are defined with help of another coupling element of another luggage item and with help of a trolley coupling element of a luggage trolley. This other coupling element is similar to the first coupling element, and, in an embodiment, this other coupling element is equal to the first coupling element. Thus, the second element has such a shape that it is configured to engage with the trolley coupling element and has such a shape that is configured to engage with the other coupling element that is similar to the first coupling element. In other words, when the first coupling element and the second coupling element are isolated from the luggage item, they both have a shape such that they are able to engage to each other and that they can be used to releasably attach different luggage items to each other. Because, as defined, the other luggage item can be releasably attached to the luggage item, and the luggage item can be releasably attached to the trolley coupling element, the term engaging, as used above, may be interpreted as engaging in such a way that they can be disengaged, released, from each other.

In an optional embodiment, the other luggage item includes the same features as the luggage item of the invention, such as a first side, a second side, a first coupling element and a second coupling element.

The first coupling element includes two first coupling profiles each including a first groove, a first surface and a second surface. The first surface and the second surface face the first groove. When the first coupling element engages with a further coupling element of other luggage item, the first surface limits a relative movement of the other luggage item with respect to the luggage item in a first direction and the second surface limits a relative movement of the other luggage item with respect to the luggage item in a second direction. The second direction is different from the first direction. The openings of the first grooves face away from each other and each opening faces into a direction of one of the flanks. It is to be noted that instead of the term groove, the term slit may be read as well. It is further to be noted that the other luggage item includes the further coupling element which is substantially equal to the second coupling element of the luggage item.

Optionally, the first coupling profiles are two first L-profiles which extend from the front side of the luggage item. The first L-profiles include a first leg being oriented substantially parallel to the first side. Two first grooves are formed between the first legs and the front side and an opening of each one of the first grooves faces into a direction of one of the flanks.

Optionally, the first coupling profiles have an orientation which is substantially perpendicular to a bottom flank of the luggage item and the first coupling profiles are arranged substantially parallel. However, in other embodiment, the first coupling profiles have an orientation such that they slightly taper toward each other in a direction towards a top flank being opposite the bottom flank. Especially, when the first coupling profiles slightly taper, they may provide in certain circumstances a better coupling to the other luggage item.

In an alternative embodiment, the first coupling element includes a T-profile which is coupled with the bottom part of the T to the front side. In yet other alternative embodiment, the first coupling element includes a U-profiles which is coupled with the two top ends of the U to the front side and of which the bottom side of the U is cut open. In yet other embodiment, not a U-shape is used, but two L-profiles are arranged to each other wherein the grooves formed by the L's are facing each other and a small gap is present between the two L's.

Optionally, the second coupling element includes two second coupling profiles each including a second groove, a third surface and a fourth surface. The third surface and the fourth surface face the second groove. When the second coupling element engages with the other coupling element of other luggage item, the third surface limits a relative movement of the other luggage item with respect to the luggage item in the first direction and the fourth surface limits a relative movement of the other luggage item with respect to the luggage item in the second direction. The second direction is different from the first direction. The openings of the second grooves face each other. Each one of the second grooves is configured to receive a part of one of the other coupling elements of the other luggage item. Each one of the first grooves is configured to receive a part of the further coupling elements of the other luggage item.

The second coupling element of this embodiment well engages with the first coupling element discussed in the previous embodiment. It is easy for a user to couple the two elements to each other by sliding a part of the first coupling profiles into the second grooves of the second coupling profiles, or sliding a part of the second coupling profiles into the first grooves.

Optionally, the second coupling element includes two second L-profiles which extend from the second side. The second L-profiles include a second leg being oriented substantially parallel to the second side. Two second grooves are formed between the second legs and the second side and openings of the second grooves face each other. Each one of the second grooves is configured to receive a first leg of the first L-profiles of the other luggage item, and each one of the legs is configured to be received by one of the first grooves of the first L-profiles of the other luggage item. Thus, the second coupling element includes similar L-profiles as the first coupling element, however, the grooves of the second L-profiles face other direction than the grooves of the first L-profiles. It is to be noted that instead of the term groove, the term slit may be read as well.

Optionally, the second coupling profiles have an orientation which is substantially perpendicular to the bottom flank and the second profiles are arranged substantially parallel. However, in other embodiment, the second coupling profiles have an orientation such that they slightly taper toward each other in a direction towards a top flank being opposite the bottom flank. Especially, when the second coupling profile slightly taper, they may provide in certain circumstances a better coupling to the other luggage item.

In an alternative embodiment, the second coupling element includes a T-profile which is coupled with the bottom part of the T to the second side. In yet other alternative embodiment, the second coupling element includes a U-profile which is coupled with the two top ends of the U to the second side and of which the bottom side of the U is cut open. In yet other embodiment, not a U-shape is used, but two L-profiles are arranged towards each other wherein the grooves formed by the L's are facing each other and a small gap is present between the two L's.

Optionally, each one of the first coupling profiles includes a first top end which faces away from the bottom flank. The first top ends of the first coupling profiles are open such that a part of the further coupling profiles of the other luggage item can be slid into the first grooves via the open first top ends. Optionally, each one of the first coupling profiles includes a first bottom end which faces towards the bottom flank. The first bottom ends of the first coupling profiles are closed such that the further coupling profiles of the other luggage item cannot be slid further then the closed first bottom ends. Optionally, each one of the second coupling profiles include a second bottom end which face towards the bottom flank. The second bottom ends of the second coupling profiles are open such that a part of the other coupling profiles of the other luggage item can be slid into the second grooves via the open second bottom end. Optionally, ach one of the second coupling profiles include a second top end which faces away from the bottom flank. The second top ends of the second coupling profiles are closed such that, when the other coupling profiles of the other luggage item are slid into the first grooves cannot be slid further than the close second top ends.

In other words, the ends of the coupling profiles are arranged such that they either have the function of receiving other coupling profile when they are open, or they have the function of preventing any further sliding of the other coupling profile when they are closed. Subsequently, when the closed ends prevent the further sliding of the other coupling profile, a part of the mass of the other luggage item, which includes the other coupling profile, is supported by the closed ends of the coupling profile. By carefully designing the position of the open en closed ends of the plurality of coupling profiles, the mass of the other luggage item is well supported by different closed ends of the plurality of coupling profiles.

Optionally, the luggage item further includes a protrusion arranged at an edge of the second side to engage with a recess of the luggage trolley. An advantageous effect of the protrusion is that a more stable coupling of the luggage item to a luggage trolley which has a corresponding recess. Optionally, the luggage item may include two protrusions arranged at the edge to engage with two recesses of the luggage trolley. Furthermore, in an optional embodiment, the protrusion(s) may have the shape of a tooth, which means that it has a rectangular shape and has a relatively small thickness. Especially, when the protrusion has the shape of a tooth, or when more than one protrusion are present, the engaging of the protrusion(s) with the recess(es) prevents that the luggage item is able to turn, twist or rotate when being engaged with the luggage trolley.

Optionally, the luggage item has a handle for carrying the luggage item and/or for lifting up the luggage item such that is disengages form other luggage item or disengages from the luggage trolley.

Optionally, the second coupling element has locking means to lock the second coupling means into a first coupling means when the second coupling means is engaged with the first coupling means. The locking means includes a locking protrusion movable between a first position and a second position and a resilient member to apply a force to the locking protrusion to move the locking protrusion into the first position. The locking means is configured to allow a movement of the locking protrusion to the second position when a part of one of the first coupling profiles is slid into the second groove and is configured to move the locking protrusion back to the first position when a hole in a part of the one of the first coupling profiles is in front of the locking protrusion. The locking means is useful to prevent an unexpected release of the luggage item (including the locking means) from other luggage item to which the luggage item is being coupled. For example, if two luggage items are coupled to each other and the combination is placed on a moving staircase, the two luggage items are fastened to each other and they do not disengage when one of them is placed on a first step and the other one is placed on a second step.

Optionally, the handle for carrying the luggage item is coupled to the locking means of the second coupling element to unlock the locking means when the handle is pulled. This is very user friendly. User have as a reflex to pull the handle of the luggage item in order to detach it from the other luggage item, and, when the user pulls the handle, the luggage item is unlocked such that it can be detached from the other luggage item.

According to a second aspect of the invention, a luggage system is provided which includes a luggage item according to the first aspect of the invention and a luggage trolley to carry the luggage item. The luggage trolley includes wheels for wheeling the luggage trolley and a trolley frame. The trolley frame includes a trolley coupling element to engage with the second coupling element of the luggage item to releasably attach the luggage item to the luggage trolley. The luggage system according to the second aspect of the invention is a very flexible luggage system. The luggage item can be releasably fastened to the luggage trolley. The luggage item can be coupled to other luggage item. If other luggage item is available, the other luggage item can also be coupled to the luggage trolley. The luggage items may have different sizes. Etc.

The luggage item system according to the second aspect of the invention provides the same benefits as the luggage item according to the first aspect of the invention and has similar embodiments with similar effects as the corresponding embodiments of the luggage item.

The trolley coupling element may be different from the first coupling element of the luggage item and is at least designed such that it engages with the second coupling element. In an optional embodiment, the trolley coupling element is similar to the first coupling element such that it may engage with the second coupling element.

The luggage item system according to the second aspect of the invention provides a means to transport one or more luggage items by coupling the luggage item(s) to the luggage trolley and coupling luggage items to each other, independently of the size of the luggage items. Thus a system is obtained with which a relatively large amount of luggage can be transported.

Optionally, the trolley includes a recess for receiving the protrusion of the luggage item. As discussed before, the trolley may also include more than one recess each one configured to receive a protrusion of the luggage item. The recess may be a rectangular shaped recess.

Optionally, the trolley coupling element includes a locking mechanism for fastening the luggage item to the luggage trolley. A fastening of the luggage item to the luggage trolley is advantageous to prevent unsafe situations and unexpected disengagement of the luggage item from the luggage trolley. Also, when the luggage item coupled to the luggage trolley is checked in for a flight, the two items do not disengage during luggage handling and none of the two items will be lost.

Optionally, the luggage item system further includes other luggage item which includes the same features as the luggage item according to the first aspect of the invention. The luggage items are flexibly engageable to each other and the luggage item or the other luggage item can be engaged with the luggage trolley. The system is very flexible. The luggage item and the other luggage item may also have different sizes.

According to a third aspect of the invention, a luggage item adaptor is provided to adapt an existing luggage item for use in a luggage item system that includes a luggage trolley and other luggage item adaptor or a luggage item. The luggage item adaptor includes a recess, a first side, a second side, a first coupling element and a second coupling element. The recess is for receiving an existing luggage item. The second side is opposite the first side and being separated by the recess from the first side. The first side and the second have an area which his larger than flanks of the luggage item adaptor. The flanks are outer areas of the luggage item adaptor which are in between the first side and the second side. The first coupling element is arranged at the first side. The second coupling element is arranged at the second side to engage with the other coupling element of the other luggage item adaptor or of the luggage item to releasably attach the other luggage item adaptor to the luggage item adaptor and to engage with a trolley coupling element of the luggage trolley to releasably attach the luggage item adaptor to the luggage trolley. The other coupling element of the other luggage item adaptor or of the luggage item is equal to the first coupling element. The first coupling element includes two first coupling profiles each including a first groove, a first surface and a second surface, the first surface and the second surface face the first groove, when the first coupling element engages with a further coupling element of the other luggage item adaptor. The first surface is for limiting a relative movement of the other luggage item adaptor with respect to the luggage item adaptor in a first direction and the second surface is for limiting a relative movement of the other luggage item adaptor with respect to the luggage item adaptor in a second direction being different from the first direction. The openings of the first grooves face away from each other, each opening faces into a direction of one of the flanks.

The recess may be a flat-box shaped recess and has a size suitable to receive conventional luggage items. The luggage item adaptor allows the use of the related art luggage items in the luggage item system according to the second aspect and allows the coupling of the luggage item adaptor to luggage items of the first aspect. Thus, although related art luggage items are not immediately useable in the luggage item system of the second aspect, the luggage item adaptor provides means to use them in this system. Further, the luggage item adaptor according to the third aspect provides the same benefits as the luggage items according to the first aspect and has similar embodiments with similar effects as the corresponding embodiments of the luggage items.

These and other aspects are apparent from and will be elucidated with reference to the embodiments described hereinafter.

It will be appreciated by those skilled in the art that two or more of the above-mentioned options, implementations, and/or aspects of the invention may be combined in any way deemed useful.

Modifications and variations of the luggage item, the luggage item system and the luggage item adaptor, which correspond to the described modifications and variations of the luggage item and/or luggage item system, can be carried out by a person skilled in the art on the basis of the present description.

Figure 1:
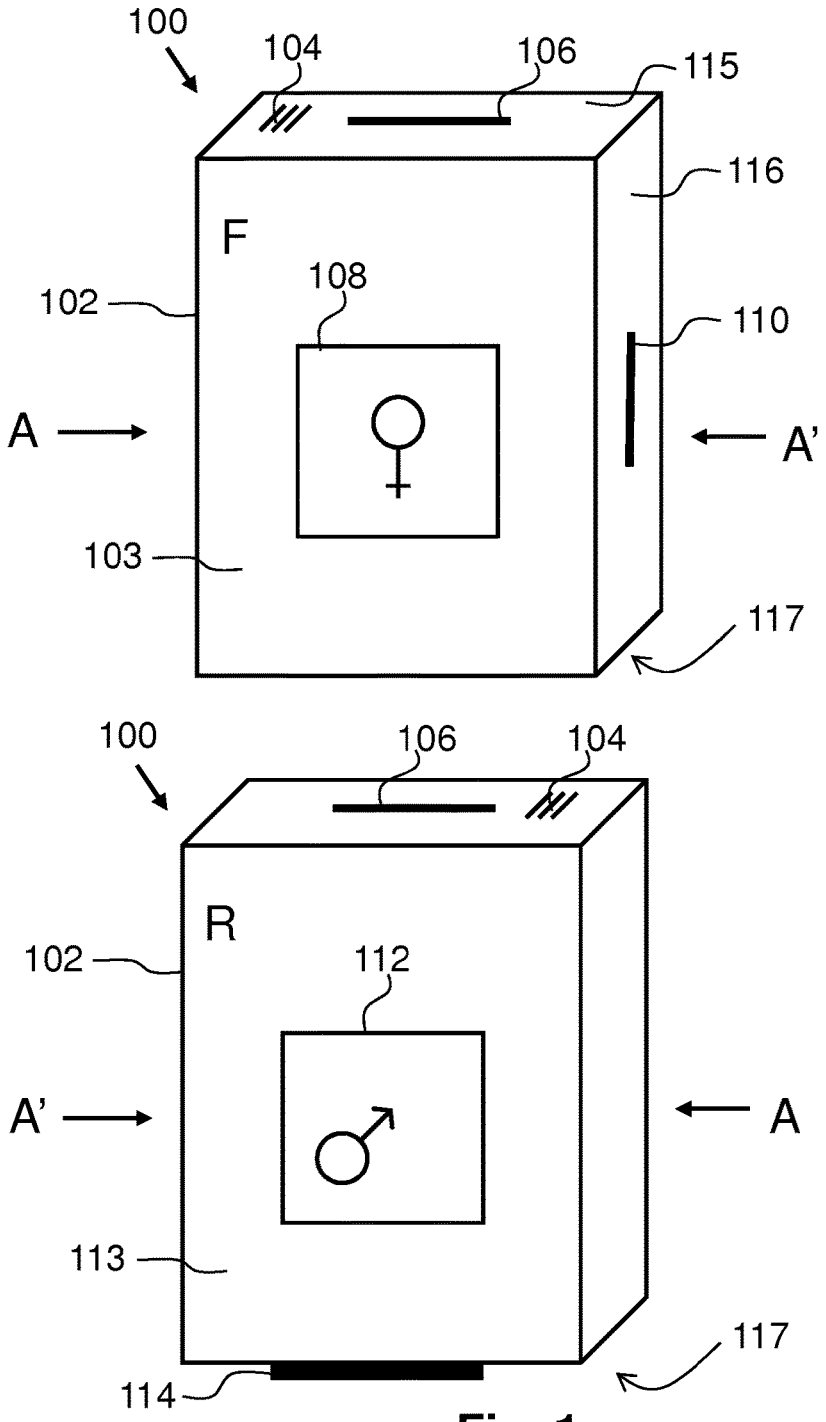
FIG. 1 schematically shows a three dimensional view of a luggage item according to the first aspect of the invention, FIGS. 2*a* and 2*b* schematically show an embodiment of a suitcase including a first and a second coupling element, FIG. 3*a* schematically shows a cross-sectional view of a luggage item similar to the luggage item of FIG. 1 along a plane A-A', FIG. 3*b* schematically shows a cross-sectional view of two luggage items which are releasably attached to each other, FIG. 3*c* schematically shows an alternative embodiment of the coupling elements, FIGS. 4*a* and 4*b* schematically show in the three-dimensional view a top of the L-profiles of the first coupling element and of the second coupling element, FIG. 5*a* schematically shows a luggage item releasably attached to a luggage trolley, FIG. 5*b* schematically shows two luggage items releasably attached to a luggage trolley, FIG. 5*c* schematically shows a luggage trolley, FIG. 6*a* schematically shows a cross-sectional view of a locking mechanism of a trolley coupling element, FIG. 6*b* schematically shows a cross-sectional view of the locking of a luggage item to trolley coupling element, FIGS. 7*a* and 7*b* schematically show a coupling mechanism integrated in the second coupling structure for releasably fastening a luggage item to other luggage item, FIG. 8 schematically shows a view of a luggage item adaptor according to the last aspect of the invention.

It should be noted that items denoted by the same reference numerals in different Figures have the same structural features and the same functions. Where the function and/or structure of such an item have been explained, there is no necessity for repeated explanation thereof in the detailed description.

The Figures are purely diagrammatic and not drawn to scale. Particularly for clarity, some dimensions are exaggerated strongly.

DETAILED DESCRIPTION

A first embodiment is shown in FIG. 1. FIG. 1 schematically shows a three dimensional view of a luggage item 100 according to the first aspect of the invention. A suitcase 100 is shown which includes a flat-box shaped housing 102. A front side 103 of the flat-box shaped housing 102 is shown at the top end of FIG. 1. At the bottom end of FIG. 1, a rear side 113 of the flat-box shaped housing 102 is shown. The front side 103 is separated from the rear side 113 by flanks 115, 116, 117. A top flank 116 includes a first handle 106 for carrying the luggage item 100 in an upright position and includes, for example, a number lock 104 for locking the luggage item 100. A side flank 116 includes a second handle 110 for carrying the luggage item 100. A bottom flank 117 is a flank which has an area being smaller than the front side 103, the rear side 113 and the side flank(s) 116. In normal use, when the luggage item 100 is put in an upright position, the luggage item 100 stays on the bottom flank 117.

The luggage item 100 may be a suitcase or any flat-boxed shape item which is suitable for carrying luggage. The flat-box shaped housing 102 is not by definition of a solid material only, but may also be flexible up to some degree or may includes areas where a flexible material is used. A sort of shopping bag may also be the luggage item in which the top flank 115 is permanently open, or which includes a lid or a cover.

The front side 103 of luggage item 100 includes a first coupling element 108 and the rear side 113 includes a second coupling element 112. The first coupling element 108 and the second coupling element 112 are configured such that, and are arranged at a position such that the luggage item 100 and the other luggage item can be releasably attached to each other by engaging the first coupling element 108 of the luggage item 100 with a second coupling element 112 of the other luggage item, or by engaging the second coupling element 112 of the luggage item 100 with the first coupling element 108 of the other luggage item (assuming that the other luggage item also includes coupling elements being equal to the first coupling element 108 and the second coupling element 112). Furthermore, the second coupling element 112 of the luggage item 100 is arranged to engage with a trolley coupling element of a luggage trolley for releasably attaching the luggage item 100 to the luggage trolley. The luggage item 100 and the other luggage items can be released by disengaging the coupling elements.

The first coupling element 108 and the second coupling element 112 are drawn schematically in FIG. 1 by means of man-woman symbol. This is a schematic representation of the fact that the coupling elements 108, 112 are configured such that one of the coupling elements may be engaged with the other one of the coupling elements. All types of coupling elements may be used. The invention is not limited to a specific coupling element. In the invention a luggage item 100 is obtained which can be used very flexible in combination with other luggage items and a luggage trolley. Luggage items of other size can be used, as long as they have the relevant coupling elements, and luggage items can be used with or without the luggage trolley. This increases user friendliness and ease of use.

Luggage item 100 has an optional further feature at an edge of its rear side 113. A tooth 114 is arranged at an edge of the rear side 113 which is close to the bottom flank 117. The tooth 114 is for engaging with a gap of the luggage trolley to which the luggage item 100 may be releasably attached. The engaging of the tooth and the gap provide a supplementary way of engaging the luggage item 100 with the luggage trolley such that the luggage item 100 is better attached to the luggage trolley.

It should be noted that, in other embodiment, the first coupling element 108 may be arranged at the rear side 113 and that the second coupling element 112 may be arranged at the front side 103. In the following description of the Figures the terms front and rear side are used. However, one may read instead of front and rear side also, respectively, first and second side, or, respectively, second and first side.

Figure 2A:
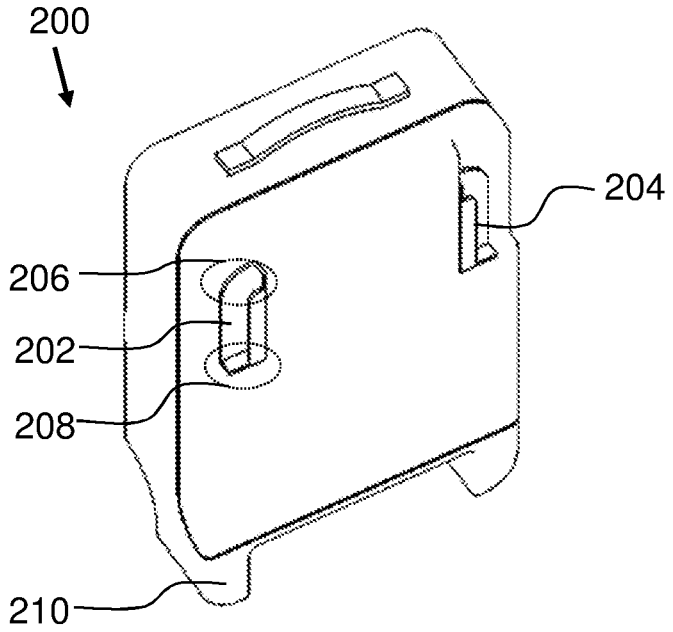
Figure 2B:
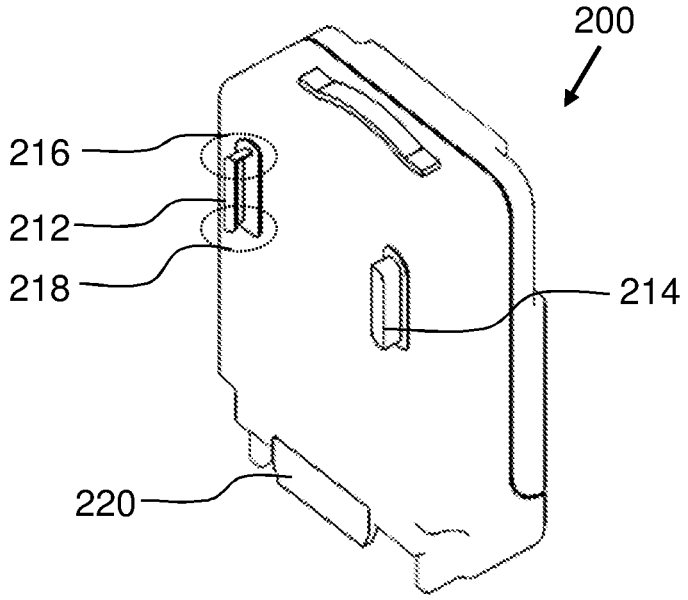

FIGS. 2*a* and 2*b* schematically show an embodiment of a suitcase 200 including a first coupling element 202, 204 and a second coupling element 212, 214. The suitcase 200 is an example of a luggage item according to the first aspect of the invention.

In FIG. 2*a* the front side of the suitcase 200 is shown. The suitcase 200 is shown in an upright position and stands on two protrusions 210 protruding from a bottom flank of the suitcase. On the front side the first coupling element is formed by a first and a second L-profile 202, 204 which enclose a groove formed in between one leg of the L-profiles 202, 204 and the suitcase. The grooves face the side flanks of the suitcase. As is indicated at the first L-profile, the top end 206 of the first L-profile 206 is an opening through which other L-profile may be slid into the groove. At the top end 206, the leg of the first L-profile 202, which runs parallel with the front side of the suitcase 200, has a rounded shape for allowing a smoother engaging with other coupling elements. The bottom end 208 of the first L-profile 202 is closed. If the first L-profile 202 engages with other L-profile, the other L-profile cannot further be slid into the groove of first L-profile 202. The other L-profile may rest on the closed bottom end 208 of the first L-profile 202. Although not extensively discussed, the second L-profile 204 has a similar open top end and a closed bottom end. The L-profiles 202, 204 enclose a groove. In an optional embodiment, the depth of the groove, measured in a direction substantially parallel to the front side of the suitcase 200, may decrease in a direction towards the bottom flank of the suitcase. This provides initially, when profiles of other coupling element are slid into the grooves, an easy insertion of the profiles and with the decreasing depth the other coupling element is guided towards the desired position when the profiles are slid further into the grooves.

In FIG. 2*b* the back side of the suitcase 200 is shown. At the back side a second coupling element is provided which includes a third L-profile 212 and a fourth L-profile 214. Between a leg of the third and fourth L-profile 212, 214 and the suitcase are formed grooves which face each other. The grooves are configured to receive L-profiles of other coupling element. As shown in FIG. 2*b*, the top end 216 of the third L-profile 212 is closed. The top end 216 prevents that other L-profile is slid into the groove behind the closed top end 216. The bottom end 218 of the third is open through which other L-profile can be slid into the groove formed by the third L-profile 212. The fourth L-profile 214 has a similar open bottom end and a closed top end. It is further shown in FIG. 2*b* that the suitcase 200 has at a bottom edge of the back side a tooth 220 which is configured to engage with a gap in a luggage trolley. The L-profiles 212, 214 enclose a groove. In an optional embodiment, the depth of the groove, measured in a direction perpendicular to the rear side of the suitcase 200, may increase in a direction towards the bottom flank of the suitcase. As discussed above this provides initially, when the L-profiles 212, 214 are slid into grooves of other coupling element, an easy insertion and the increasing depth guides the L-profiles 212, 214 towards the desired position when the L-profiles 212, 214 are slid further into the grooves.

The first and second L-profiles 202, 204 of the suitcase 200 are configured to engage with L-profiles of other suitcase being equal to the third and fourth L-profiles 212, 214 of the suitcase 200. In a similar way, the third and fourth L-profiles 212, 214 of the suitcase 200 are configured to engage with L-profiles of other suitcase being equal to the first and second L-profiles 202, 204 of the suitcase 200. Thus, other suitcase which also includes the first and the second coupling element can be releasably attached to the suitcase 200, either to its front side or to its back side.

Furthermore, the second coupling element of the back side, including the third and fourth L-profile 212, 214, is configured to engage with a luggage trolley coupling element for releasably attaching the suitcase 200 to the luggage trolley.

Figure 3A:
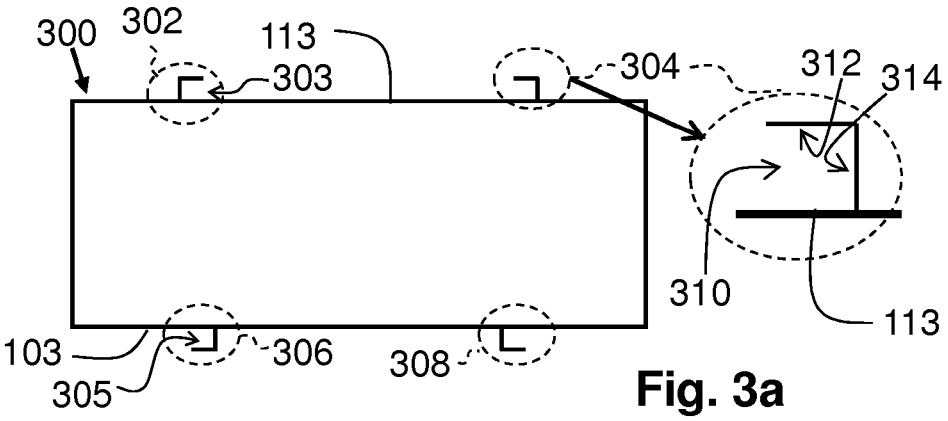
Figure 3B:
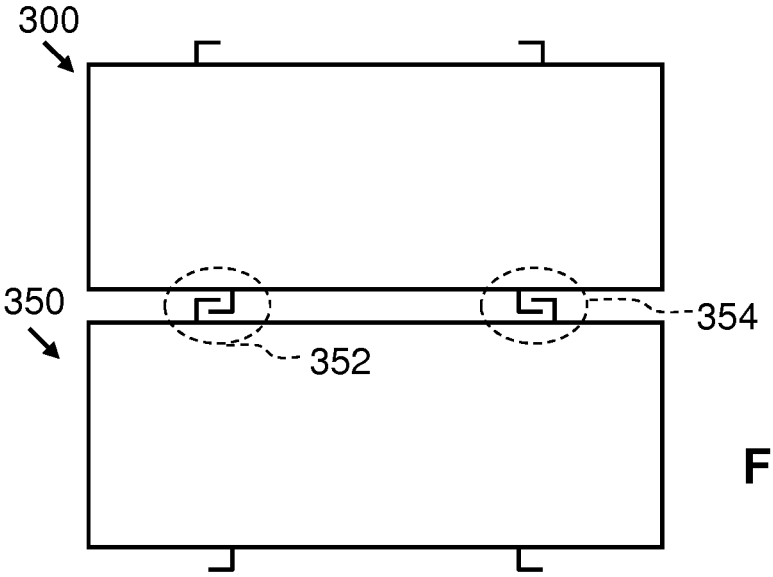
Figure 3C:
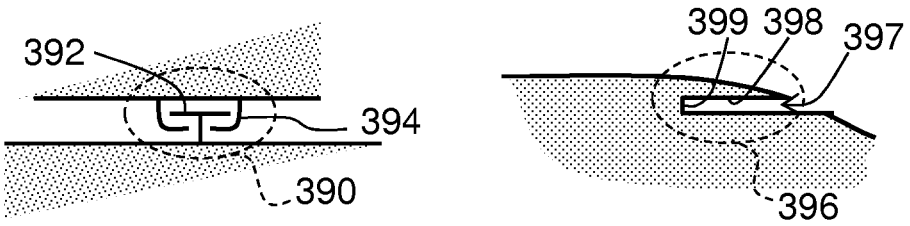

FIG. 3*a* schematically shows a cross-sectional view of a luggage item 300 similar to the luggage item 100 of FIG. 1. In FIG. 1 a plane is indicated with A-A' and the cross-sectional views of FIGS. 3*a* to 3*c* are along the plane A-A'. The front side 103 of the luggage item 300 includes a first coupling element which includes two L-profiles 306, 308. One of the legs of the L-profiles 306, 308 runs parallel with the front side 103 of the luggage item 300. A groove 305 is present in between this parallel oriented leg and the front side 103. At the rear side 113 of the luggage item 300 a second coupling element is present which includes two L-profiles 302, 304. The L-profiles 302, 304 have a leg which runs parallel to the rear wide 113. A groove 303 is present between this parallel oriented leg and the rear side 113.

Important characteristics of L-profile 304 are explained together with the enlargement of L-profile 304 at the right end of FIG. 3*a*. Groove 310 is formed in between the L-profile 304 and the rear side 113 of the luggage item 300. A first and second surface 312, 314 of the L-profiles 304 face the groove 310. The first surface 312 is oriented substantially parallel to the rear side 113. When the L-profile 304 engages with other L-profile of other luggage item (see, for example, FIG. 3*b*), the first surface 312 prevents that the other luggage item can move away from the rear side 113 of the luggage item 300. The second surface 314 is oriented perpendicular to the rear side 113 of the luggage item 330. When the L-profile 304 engages with other L-profile of other luggage item (see, for example, FIG. 3*b*), the second surface prevents that the other luggage item is able to move in a sidewards direction (which is in FIG. 3*a* a direction to the right). Each one of the L-profiles 302, 306, 308 have a first surface and a second surface which face the groove of the respective L-profiles 302, 306, 308 and each one of these surfaces prevents a movement of other luggage item which is being coupled to the luggage item 300 in a specific direction.

FIG. 3*b* schematically shows a cross-sectional view of two luggage items 300, 350 which are releasably attached to each other. The luggage item 300 includes the coupling element as discussed in the context of FIG. 3*a*. The other luggage item 350 includes the same coupling element as the luggage item 300. The other luggage item 350 may have a different size and/or have a different outer material. As shown at positions 352, 354, the first coupling element of the luggage item 300 engages with the second coupling element of the other luggage item 350. The parallel running legs of the L-profiles are slid into the grooves formed by these parallel running legs of the L-profiles. In this way a stable connection is made between the luggage item 300 and the other luggage item 350. The other luggage item 350 and the luggage item 300 can be disengaged by sliding the L-profiles of one item out of the grooves of the other item.

FIG. 3*c* schematically shows two alternative embodiments of the coupling elements of two luggage items which are releasably attached to each other. The coupling shown at the left end, and which is indicated by location 390 includes a T-profile 392 as being part of a first coupling element and a sort of U-profile 394 in which a saw kerf has been made. The T-profile 392 can be slid into the U-profile 394 and results in the coupling as shown in FIG. 3*c*. Both the T-profile 392 and the U-profile 394 includes at least two surfaces which face one of the grooves formed between the profile and the luggage item and these at least two surface limited the movement of the coupled luggage items with respect to each other. At the right end of FIG. 3*c*, a profile 396 is presented which is formed into a solid, massive, shell of a luggage item which has a slight curvature near the edges of the rear and/or front surfaces of the luggage item. The shell is, for example, made by injection molding and the mold including a profile which forms the groove 397 of the profile 396. In other embodiment, the groove 397 is formed with a grinder into the shell of the luggage item. The profile 396 has at least a first and second surface 398, 399 which face the groove 397. Each one of the first and the second surface 398, 399 limit the movement of other luggage item, which is coupled to the profile 396, into a first and a second direction.

Figure 4A:
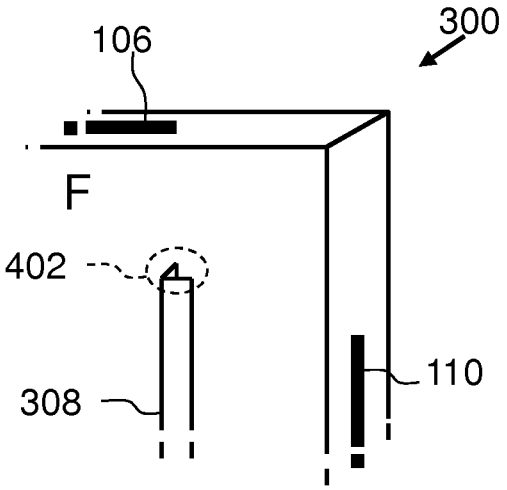
Figure 4B:
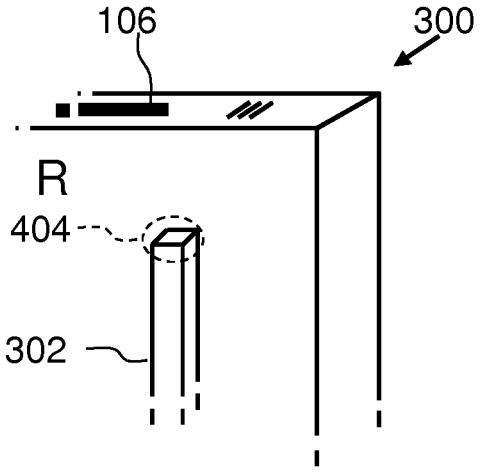

FIGS. 4*a* and 4*b* schematically show in the three-dimensional view a top 402, 404 of the L-profiles of the first coupling element and of the second coupling element. The L-profiles 308 of the first coupling element at the front side of the luggage item 300 have at one end a top opening 402. Other L-profile can be slid via the top opening 402 into the groove between the L-profile 308 and the first side. The end of the L-profile, which is open, is the end that faces away from the bottom flank of the luggage item 300—thus, in normal use, when the luggage item 300 is arranged in an upright position, the top opening 402 can be seen when looking from above to the L-profile 308. The L-profile 302 of the second coupling element has at one end a closed top 404. When the L-profile 302 of the second coupling element is slid into the groove of the L-profile 308 of the first coupling element, the closed top 404 prevents that the L-profile 302 of the second coupling element can be slid to a further position. Thus, if the first and the second coupling element of different luggage items are engaged, one of the luggage items may rest with the closed top 404 of the second coupling element on an end of the L-profile of the first coupling element.

Figure 5A:
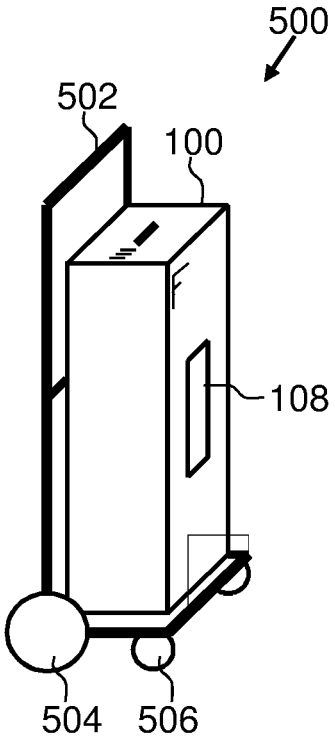

FIG. 5*a* schematically shows a luggage system 500 in which a luggage item 100 releasably attached to a luggage trolley 502. The luggage trolley 502 includes rear wheels 504 and front wheels 506. The luggage trolley 502 is for wheeling the luggage item 100 while travelling. The luggage trolley 502 may be pushed or pulled. The rear wheels 504 are larger in diameter than the front wheels 506. Alternatively, the rear wheels 504 and the front wheels 506 have an equal diameter. A luggage item 100 is releasably fastened to the luggage trolley 502. At the front side of the luggage item 100, a first coupling element 108 is shown. The luggage item 100 has at its rear side a second coupling element (not shown). The second coupling element engages with a trolley coupling element (not shown).

Figure 5B:
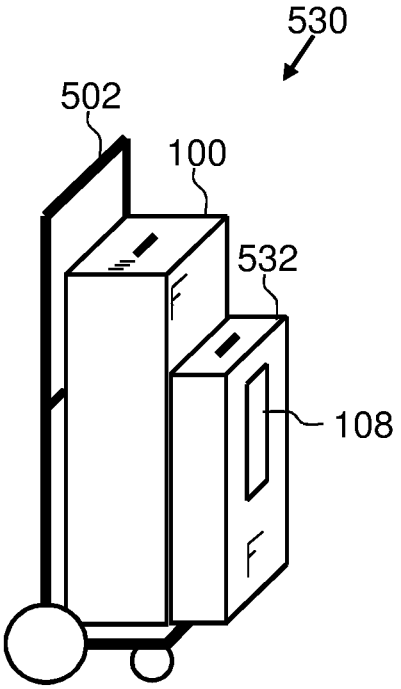

FIG. 5*b* schematically shows a luggage system 530 in which two luggage items 100, 532 are releasably attached to a luggage trolley 502. The luggage item 100 is similar to previously discussed luggage item 100. The other luggage item 532 is a relatively small suitcase which includes at its front side also a first coupling element 108 and at is rear side also a second coupling element (not shown). The first coupling element of the luggage item engages with the second coupling element of the other luggage item 532 and in this way the other luggage item 532 is releasably attached to the luggage item 100. The luggage item 100 is releasably attached to the luggage trolley 502 and, thus, the luggage trolley 502 carries both luggage items 100, 532.

Figure 5C:
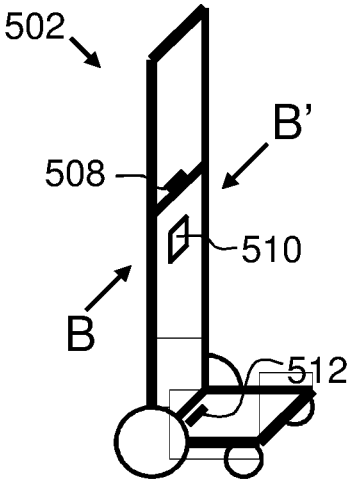

FIG. 5*c* schematically shows the luggage trolley 502 of the luggage systems 500, 530. The luggage trolley 502 includes a trolley coupling element 510 which is configured to engage with a second coupling element of previously discussed embodiments of the luggage items. Further, the luggage trolley 502 may include a gap 512 in which a tooth of a luggage item may be slid for releasably attaching such a luggage item to the luggage trolley 502. For example, the gap 512 is for receiving the tooth 114 of the luggage item 100 of FIG. 1. Further, the trolley coupling element 510 may include a locking means for locking a position of the luggage item which is releasably attached to the luggage trolley 502 to prevent that the luggage item is unexpectedly released from the luggage trolley 502. The luggage trolley 502 may include an unlocking lever 508 which is coupled to the locking means for unlocking the locking means. It is to be noted that the unlocking level 508 may also be provided as an unlocking button.

Figure 6A:
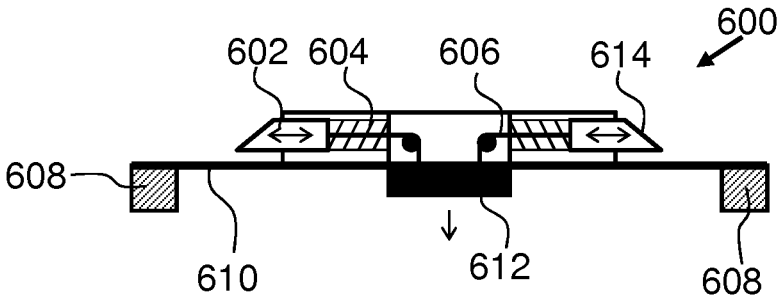

FIG. 6*a* schematically shows a cross-sectional view of a locking mechanism 600 of a trolley coupling element along line B-B' indicated in FIG. 5*c*. In the cross-sectional view a cross-section of the bars of the frame 608 of the luggage trolley can be seen. Between the bars 608 is arranged a back panel 610 or a means to couple the trolley coupling element to the bars 608 of the trolley frame. The trolley coupling element includes sidewards movable locking bars 602, 614 which are kept by a resilient member 604 in a first position. The locking bars 602, 614 move inwards to a second position when one pushes to the locking bars 602, 614. In FIG. 6*a* the locking bars 602, 614 are drawn in their first position. Ends of the locking bars 602, 614 are tapering such that when a second coupling element of a luggage item is pressed against the tapering end, the locking bars 602, 614 move to the second position and allow a passage of parts of the second coupling elements. The resilient means 604 are, for example, a spring, or a piece of rubber-like material. The locking bars 602, 614 are coupled with a cable 606 or chain to an unlocking lever 612. By pulling the unlocking lever 612, the locking bars 602, 614 are pulled towards the second position such that a luggage item can be disengaged from the trolley coupling element.

Figure 6B:
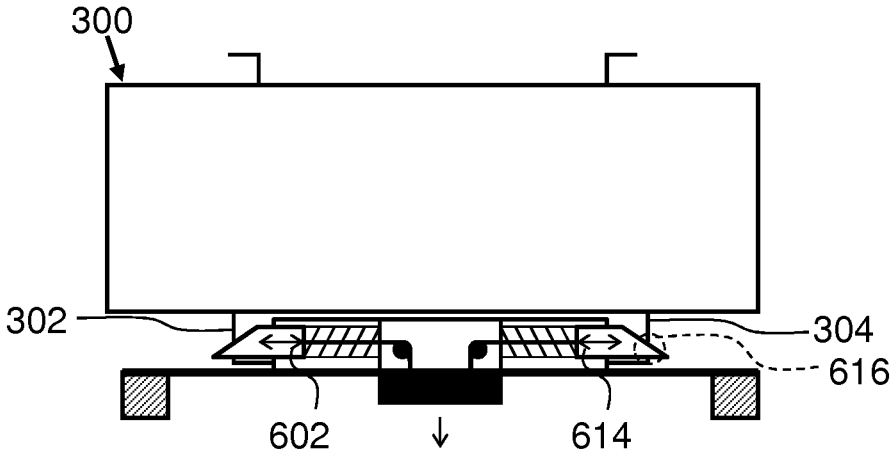

In FIG. 6*b* the locking of a luggage item 300 is schematically shown in a cross-sectional view. The L-profiles 302, 304 are locked behind the locking bars 602, 614 which are in their first position. Only when the locking bars are pulled towards the second position, the L-profiles 302, 304 are able to pass the locking bars and can the luggage item 300 be released from the luggage trolley. As shown at position 616, the L-profiles 302, 304 may have an opening and the locking bars 602, 614 fall into the openings such that the luggage item 300 is well fastened to the luggage trolley.

Figure 7A:
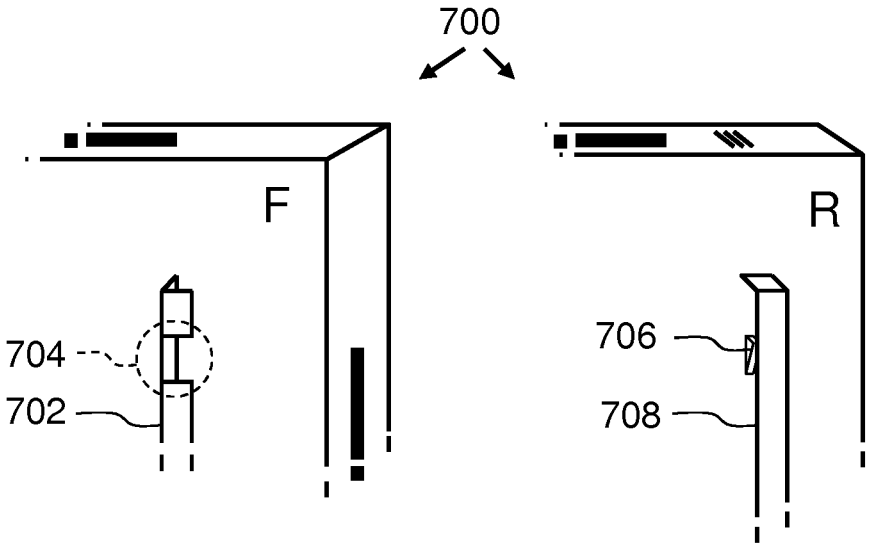
Figure 7B:
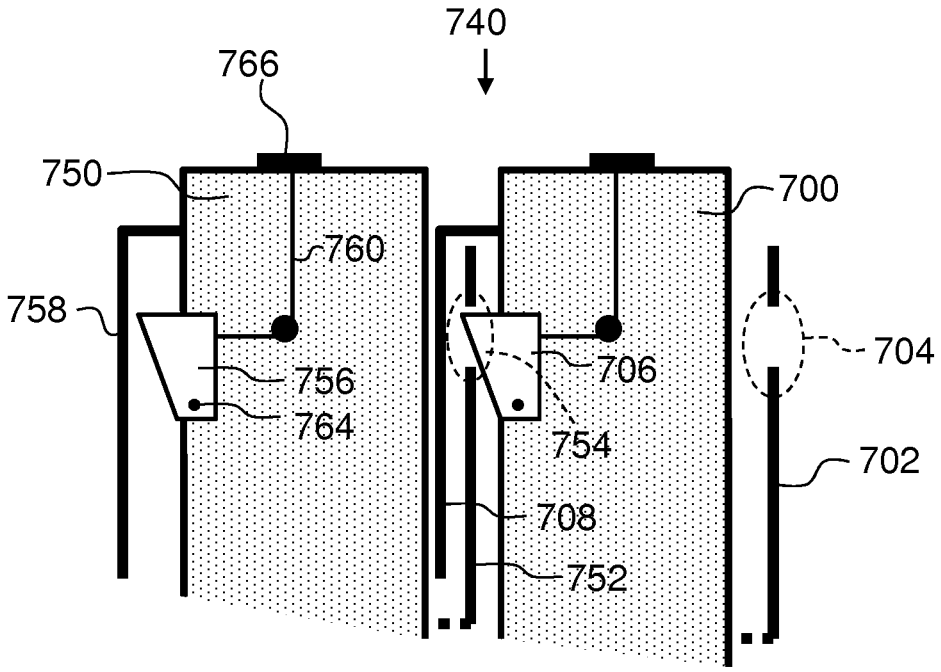

FIGS. 7*a* and 7*b* schematically show a coupling mechanism integrated in the second coupling structure for releasably fastening a luggage item 700 to other luggage item 750. The luggage item 700 is shown more in detail in FIG. 7*a*. At the left end of FIG. 7*a*, it is shown that the L-profile 702 of the first coupling mechanism has an opening 704 in the leg which runs parallel to the front side of the luggage item 700. The opening 704 is for receiving a locking protrusion which is integrated in the second coupling mechanism of a luggage item to which the luggage item 700 is going to be coupled. At the rear side, which is shown at the right end of the FIG. 7*a*, it is seen that a locking protrusions 706 protrudes into the groove in between the L-profile 708 of the second coupling mechanism and the rear side.

In FIG. 7*b* a cross-sectional view of two luggage items 700, 750 is shown which are coupled to each other with their respective coupling elements. The luggage items 700, 750 include a locking mechanism for releasably fastening the luggage item 700 to the other luggage item 750. As shown in FIG. 7*b*, the locking mechanisms include a locking protrusion 706, 756 which protrudes into the groove in between the L-profiles 758, 708 and the respective back sides of the luggage items 700, 750. In the left luggage item 750 it is shown that the locking protrusion 756 is rotatably mounted with an axis 764 to the luggage item 750. The locking protrusion 756 is coupled with, for example, a cable 760 to the handle bar 766 which the user can use to unlock the locking mechanism. As shown in FIG. 7*b*, the locking protrusions 706, 756 return to their position after pulling the handle bar. The locking mechanism may include a resilient member which applies a force to the locking protrusion to move it towards the position shown in FIG. 7*b*.

The left luggage item 750 has an L-profile 758 at its back side and has the above discussed locking protrusion 756. At its front side it has, as part of its first coupling element, an L-profile 752 which has an opening 754 in one of its legs.

The right luggage item 700 has at is front side an L-profile 702 as part of its first coupling element and the L-profile includes an opening 704 for receiving a locking protrusions of other luggage item. The right luggage item 700 has also at its back side an L-profile 708 as part of its second coupling element and has a locking protrusion 706 which protrudes into the groove formed by the L-profile 708. In FIG. 7*b*, the second coupling element of luggage item 700 engages with the first coupling element of luggage item 750. When the L-profile 708 was slid into the groove formed by L-profile 752, the locking protrusion 706 was pushed into the rear side of luggage item 700 until the locking protrusion 706 arrived at opening 754. Because the tendency of the locking protrusions 706 to return to the position shown in FIG. 7*b*, the top of the locking protrusion 706 moved into the opening 754 thereby locking the relative position of the right luggage item 700 with respect to the left luggage item 750.

Figure 8:
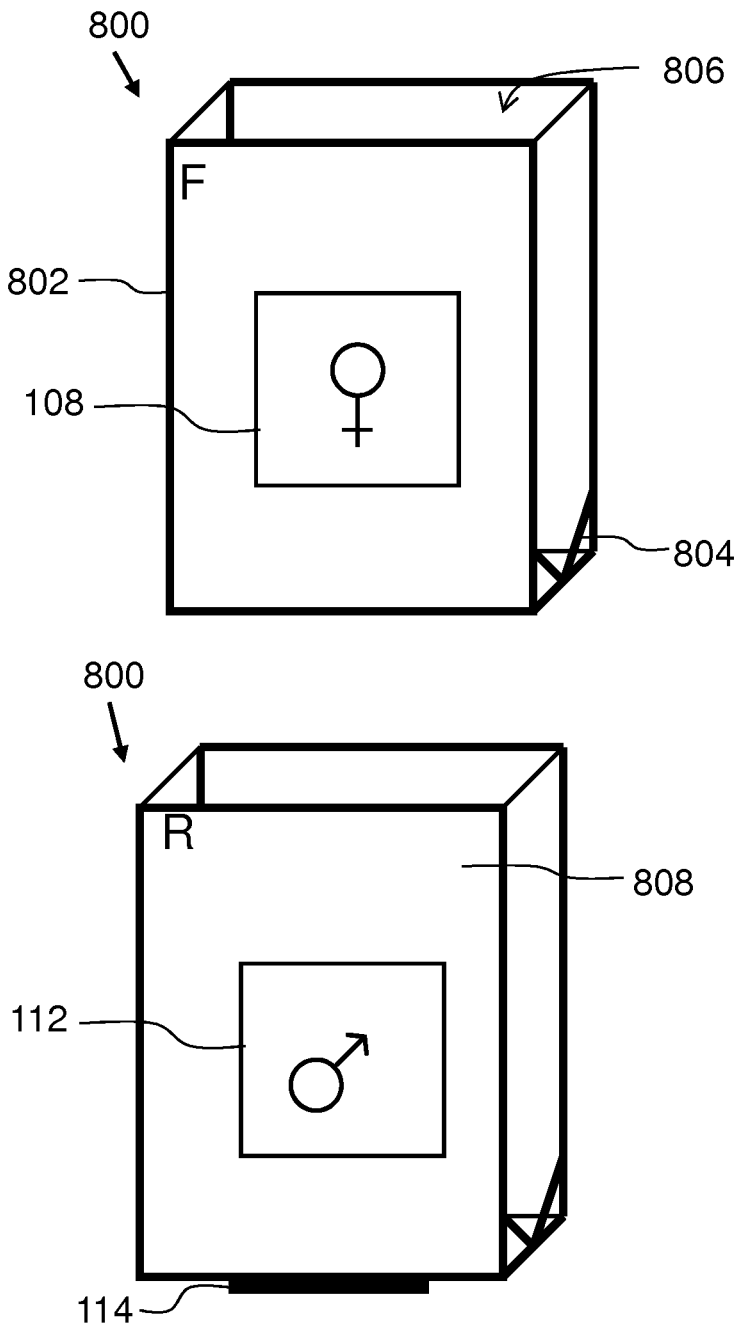

FIG. 8 schematically shows a three dimensional view of a luggage item adaptor 800 according to the last aspect of the invention. The luggage item adaptor 800 includes a recess 806 for receiving a luggage item, such as, for example, a suitcase or a sports bag. The luggage item adaptor 800 includes a frame 802 which outer dimensions form a flat-shaped box. When the luggage item adaptor 800 is in an upright position, the top of the luggage item adaptor 800 provides access to the recess 806. The flanks of the luggage item adaptor 800 may also be open and may also be provided with additional bars 804 for increasing the strength of the frame 802 of the luggage item adaptor 800. Two opposite sides of the luggage item adaptor 800, which are the largest surfaces, may be closed with a panel and are defined as being a front side and a rear side. A first coupling element 108 is arranged at the front side and a second coupling element 112 is arranged at the back side. The first coupling element 108 and the second coupling element 112 are configured such that a first luggage item adaptor 800 can be releasably attached to a second luggage item adaptor when they both include the same types of coupling element 108, 112. A first coupling element 108 of the first luggage item adaptor 800 may engage with a second coupling element of the second luggage item adaptor, or a second coupling element 112 of the first luggage item adaptor 800 may engage with a first coupling element of the second luggage item adaptor. Furthermore, the first coupling element 108 and the second coupling element 112 may be configured such that they may engage with, respectively a second coupling element and a first coupling element of, for example, the luggage item 100 of FIG. 1. And, the second coupling element is configured to be engageable with a trolley coupling element of, for example, the luggage trolley 502 of FIG. 5. The luggage item adaptor 800 may further include at its rear side a tooth 114 for engaging with a gap of the luggage trolley 502.

It should be noted that the above-mentioned embodiments illustrate rather than limit the invention, and that those skilled in the art will be able to design many alternative embodiments without departing from the scope of the appended claims.

In the claims, any reference signs placed between parentheses shall not be construed as limiting the claim. Use of the verbs include and "comprise" and their conjugations do not exclude the presence of elements or steps other than those stated in a claim. The article "a" or "an" preceding an element does not exclude the presence of a plurality of such elements. The invention may be implemented by means of hardware including several distinct elements. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. A suitcase system, comprising:

a first and a second suitcase, each of the first and second suitcase including:

a first side, a second side opposite the first side and separated by flanks from the first side, the first side and the second side having an area larger than the areas of the flanks, two first coupling profiles arranged at the first side, each of the first coupling profiles forming a first groove, two second coupling profiles arranged at the second side, each of the second coupling profiles forming a second groove, the two first coupling profiles being arranged for slidably receiving part of the second coupling profiles of another suitcase, openings of the first grooves facing away from each other in a direction of one of the flanks, and openings of the second grooves facing towards each other, and a protrusion arranged at an edge of the second side, a trolley for carrying the first and second suitcase, wherein the trolley includes:

wheels for wheeling the trolley, a trolley frame including a locking mechanism for engaging with the second coupling profiles of the first or second suitcase, a recess for receiving the protrusion when the first or second suitcase is placed on the trolley frame of the suitcase trolley, wherein the second coupling profiles of the first suitcase are arranged for:

a) engaging with first coupling elements of the second suitcase to releasably attach the second suitcase to the first suitcase, and b) engaging with the locking mechanism of the trolley frame to releasably attach the first suitcase to the trolley frame.

2. The suitcase system according to claim 1, wherein both the first and second coupling profiles are two second L-profiles which extend from the first and second side respectively.

3. The suitcase system according to claim 1, wherein the locking mechanism (600) comprises:

a locking bar that is movable between a first position and a second position, a resilient member for applying a force to the locking bar for moving the locking bar into the first position, and wherein the locking mechanism is configured to allow a movement of the locking bar to the second position when one of the second coupling profiles is pushed to the locking bar and is configured to move the locking bar back to the first position when the one of the surfaces of second coupling profiles is moved behind the locking bar, wherein the moving back results in a reception of an end of the locking bar by the second groove of the one of the second coupling profiles.

* * * * *